US007057378B2

(12) United States Patent
Oyama et al.

(10) Patent No.: US 7,057,378 B2
(45) Date of Patent: Jun. 6, 2006

(54) POWER SUPPLY UNIT

(75) Inventors: Katsuya Oyama, Chiyoda-ku (JP); Shoji Sasaki, Chiyoda-ku (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/684,534

(22) Filed: Oct. 15, 2003

(65) Prior Publication Data

US 2004/0108842 A1 Jun. 10, 2004

(30) Foreign Application Priority Data

Oct. 18, 2002 (JP) ..... 2002-304489

(51) Int. Cl.
*G05F 1/44* (2006.01)

(52) U.S. Cl. ..... 323/268; 323/267

(58) Field of Classification Search ..... 323/266–269, 323/274, 275, 282, 284, 285; 307/34, 18, 307/21, 25, 28, 56, 72, 75, 82
See application file for complete search history.

(56) References Cited

U.S. PATENT DOCUMENTS 5,216,353 A * 6/1993 Mori ..... 323/266
5,336,985 A * 8/1994 McKenzie ..... 323/266
5,969,512 A * 10/1999 Matsuyama ..... 323/272
6,654,264 B1 * 11/2003 Rose ..... 363/65

FOREIGN PATENT DOCUMENTS

| | | |
|---|---|---|
| JP | 04-054826 | 2/1992 |
| JP | 11-041825 | 2/1999 |
| JP | 11-265225 | 9/1999 |
| JP | 2000-060116 | 2/2000 |
| JP | 2002-023865 | 1/2002 |
| JP | 3084395 | 3/2002 |
| JP | 2002-108465 | 4/2002 |
| JP | 2002-262544 | 9/2002 |

OTHER PUBLICATIONS

Office Action dated Mar. 14, 2005.

* cited by examiner

*Primary Examiner*—Gary L Laxton
(74) *Attorney, Agent, or Firm*—Crowell & Moring LLP

(57) ABSTRACT

The reliability of the power supply unit which supplies a different voltage to the microcomputer with two or more power supplies is improved. The power supply unit is composed of first regulator 2, at least one second regulator 4 which generates the voltage lower than that of the first regulator 2, means for detecting the output voltage of the first regulator 2, and means for stopping the second regulator 4 when the output voltage V2 of the first regulator 2 drops lower than the first fixed voltage.

19 Claims, 5 Drawing Sheets

POWER SUPPLY UNIT

BACKGROUND OF THE INVENTION

The present invention relates to an electric power supply unit which supplies the electric power to an engine control unit, and particularly to an electric power supply unit for the engine control unit which supplies the DC power to a computer for controlling an automobile engine.

Recently, the size of the semiconductor wafer for one microcomputer has become small from the viewpoint of the downsizing and the cost reduction. Moreover, an electric current increases if the clock speed goes up. Then, it is necessary to reduce the voltage to satisfy the electric power and reduce the entire electric power. The blocking voltage cannot be taken for the conventional voltage when the size of IC chip of the microcomputer becomes small like this and thus the blocking voltage has become lower. That is, a CPU core power unit has an inclination of adopting a lower voltage to decrease the loss when making the microcomputer speeded up.

On the other hand, the microcomputer needs a plurality of power units, because the reference voltage of an analog to digital converter and the digital I/O power unit voltage remain the conventional 5V voltage.

In the conventional electric power supply unit, 5V voltage is generated by the switching regulator to obtain the CPU core power supply voltage, and voltage 3.3V is generated by the series regulator to obtain the CPU core power supply voltage.

Further, 5V is generated from the voltage of the battery through 7.8V generation linear regulator as a reference voltage of the AD converter (For Instance, see pages 4–5 and FIG. 1 of Japanese Patent Application Laid-Open No. 11-265225).

In this official gazette, the countermeasure to decrease the regulator loss is done like this. However, in the microcomputer which requires a plurality of power supplies (For instance, when it is necessary to supply two of 5V and 3.3V voltages), The isolation in the microcomputer collapses when the voltage of two power supplies supplied to the microcomputer is reversed, and there is a possibility to cause latch-up.

Moreover, the blocking voltage of the elements used internally tends to become low by the shrink of the microcomputer in the electric power supply unit disclosed in the above official gazette. Therefore, these elements have potential of causing the blocking voltage breakdown when the potential difference between 5V and 3.3V power supplies is large.

SUMMARY OF THE INVENTION

An object of the present. Invention is to provide a reliable electric power supply unit which supplies the power supply voltage in the regulator which generates two or more power supply voltages.

One configuration of the present invention is as follows.

An electric power supply unit comprising;

a first regulator which converts the voltage of a battery supplied by the battery into a fixed voltage, a second regulator which generates a lower voltage than said first regulator, a voltage detection means which outputs an OFF signal when the output voltage of the first regulator drops less than a first set voltage, an d outputs an ON signal when the output voltage of said first regulator rises more than a second set voltage, and a means which stops the voltage output from said second regulator when the OFF signal is output from said voltage detection means.

Because there is provided a voltage detection means which outputs an OFF signal when the output voltage of the first regulator drops less than a first set voltage, and outputs an ON signal when the output voltage of said first regulator rises more than a second set voltage in the present invention, the isolation can be prevented from collapsing in the microcomputer even when two power supply voltages supplied to the microcomputer is reversed by some circumstances, and latch-up can be prevented from being generated in the microcomputer which should supply high and low voltages.

Another configuration of the present invention is as follows.

An electric power supply unit comprising;

a first regulator which converts the battery voltage supplied by the battery into a first voltage.

a third regulator which converts the first voltage output from said first regulator into a second voltage.

a second regulator which converts the second voltage output from said third regulator into a third voltage.

a first voltage detection means which outputs an OFF signal when the second voltage output from said third regulator drops less than the first set voltage, and outputs an ON signal when the second voltage output from said third regulator rises more than the second set voltage, and a means which stops the voltage output from said second regulator when an OFF signal is output from said first voltage detection means.

Because there are provided a first voltage detection means which outputs an OFF signal when the second voltage output from said third regulator drops less than the first set voltage, and outputs an ON signal when the second voltage output from said third regulator rises more than the second set voltage, and a means which stops the voltage output from said second regulator when the second voltage output from said third regulator drops less than the first set voltage, the isolation can be prevented from collapsing in the microcomputer even when two power supply voltages supplied to the microcomputer is reversed by some circumstances, and latch-up can be prevented from being generated in the microcomputer which should supply high and low voltages.

A further configuration of the present invention is as follows.

An electric power supply unit comprising;

a first regulator which converts the battery voltage supplied by the battery into a first voltage.

a third regulator which converts the first voltage output from said first regulator into a second voltage.

a second regulator which converts the first voltage output from said first regulator into a third voltage.

a first voltage detection means which outputs an OFF signal when the second voltage output from said third regulator drops less than the first set voltage, and outputs an ON signal when the second voltage output from said third regulator rises more than the second set voltage, and a means which stops the voltage output from said second regulator when an OFF signal is output from said first voltage detection means.

Because there are provided a first voltage detection means which outputs an OFF signal when the second voltage output from said third regulator drops less than the first set voltage, and outputs an ON signal when the second voltage output from said third regulator rises more than the second set voltage, and a means which stops the voltage output from said second regulator when an OFF signal is output from said first voltage detection means, the isolation can be prevented from collapsing in the microcomputer even when two power supply voltages supplied to the microcomputer which should supply high and low voltages is reversed by some circumstances, and latch-up can be prevented from being generated in the microcomputer.

A further configuration of the present invention is as follows.

An electric power supply unit comprising a second voltage detection means which stops the first voltage output from said first regulator by outputting an OFF signal when the first voltage output from said first regulator drops less than the third set voltage.

Because a second voltage detection means which stops the first voltage output from said first regulator when the first voltage output from said first regulator drops less than the third set voltage, the microcomputer can be prevented from malfunctioning due to the decrease in the first voltage output from the first regulator.

Other features of thee present invention are explained in the embodiment described later.

DESCRIPTION OF THE PREFERRED EMBODIMENT

Figure 1:
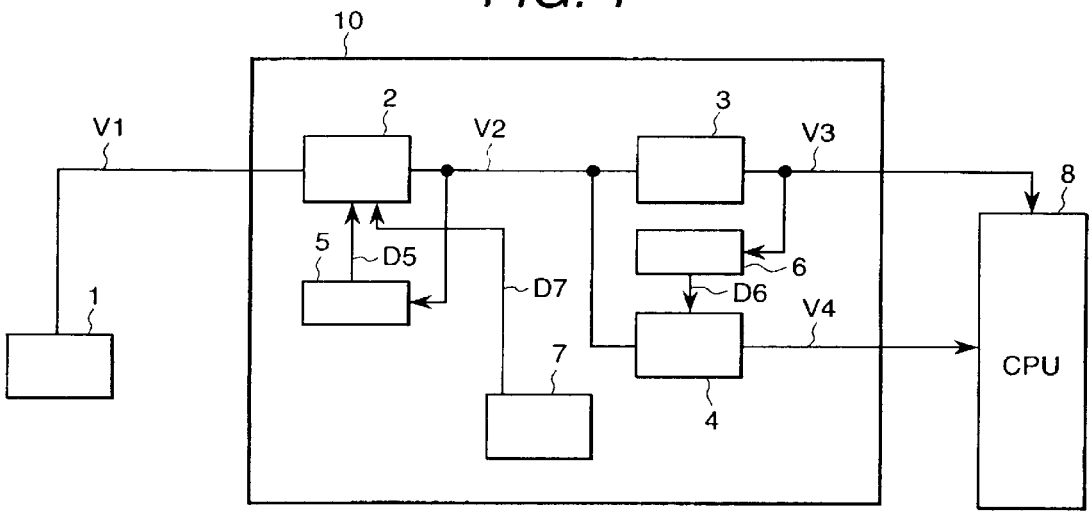
FIG. 1 is a block diagram showing the first embodiment of electric power supply unit according to the present invention.

FIG. 1 shows a first embodiment of the electric power supply unit according to the present invention.

That is, in FIG. 1, regulator 2 is connected to battery 1, and battery voltage V1 supplied by battery 1 is supplied to regulator 2. This regulator 2 converts battery voltage V1 of 22V for instance into a fixed voltage (for instance, 7.8V) and outputs it. Regulator 3 and regulator 4 are connected to the output terminal of this regulator 2.

Moreover, a voltage detector 5 (a second voltage detection means) is connected to the output terminal of this regulator 2. The output of this voltage detector 5 is connected to regulator 2. Moreover, voltage detector 6. (a first voltage detection means) is connected to the output terminal of regulator 3. The output of this voltage detector 6 is connected to regulator 4.

Electric power supply unit 10 comprises regulator 2, regulator 3, regulator 4, voltage detector 5, and voltage detector 6. Overheating detector 7 which detects the abnormal temperature in electric power supply unit 10 is provided in this electric power supply unit 10. This overheating detector 7 is connected to regulator 2. Moreover, microcomputer 8 is connected to this electric power supply unit 10.

This regulator 3 generates voltage of 5V which is most suitable for, for example, the I/O power supply of the microcomputer from output voltage V2 output from regulator 2, and outputs the voltage to microcomputer 8 as output voltage V3. Moreover, this regulator 4 generates voltage of 3.3V which is most suitable for the CPU core power supply of the microcomputer from output voltage V2 output from regulator 2, and outputs the voltage to microcomputer 8 as output voltage V4.

Regulator 2 generates by using battery voltage V1 such a voltage that the loss of regulator 3 and regulator 4 can be decreased and the target voltage V3*a* of regulator 3 and the target voltage V4*a* of regulator 4 can be output, and outputs it.

Voltage detector 5 detects the output voltage of regulator 2 (the first regulator). Voltage detector 5 outputs an OFF signal to regulator 2 when the detected output voltage of regulator 2 drops less than the first set voltage, and stops regulator 2. Further, voltage detector 5 outputs the ON signal to regulator 2 when the detected output voltage of regulator 2 rises more than the fourth set voltage, and reactivates regulator 2 which is at rest temporarily.

Voltage detector 6 detects the output voltage of regulator 3. Voltage detector 6 outputs an OFF signal to regulator 4 when the detected output voltage of regulator 3 drops less than the first set voltage, and stops regulator 4. Further, voltage detector 6 outputs an ON signal to regulator 4 when the detected output voltage of regulator 3 rises more than the second set voltage, and reactivates regulator 4 which is at rest temporarily.

Overheating detector 7 detects the abnormal temperature in electric power supply unit 10. Overheating detector 7 outputs an OFF signal to regulator 2 (the first regulator) when the internal temperature of electric power supply unit 10 reaches the first set temperature, and stops regulator 2. Further, overheating detector 7 outputs an ON signal to regulator 2 when the internal temperature of electric power supply unit 10 begins to descend from the second set temperature, and reactivates regulator 2 which is at rest temporarily.

Because the processing speed of the microcomputer becomes high in recent years, microcomputer 8 connected to electric power supply unit 10 has a plurality of electric power supply units. Output voltage V3 output from regulator 3 is chiefly input to this microcomputer 8 as an. I/O power supply unit (generally, 5V and output voltage V4 output from regulator 4 is input as a CPU core power supply unit (generally, 3.3V, but tend to become lower, for example, 2.6V or 1.8V, in future).

Regulator 3 shown in FIG. 1 generates voltage of 5V suitable for the I/O power supply unit of the microcomputer from battery voltage V1 supplied by battery 1, and outputs the voltage to microcomputer 8 as output voltage V2 (the first voltage).

Figure 2:
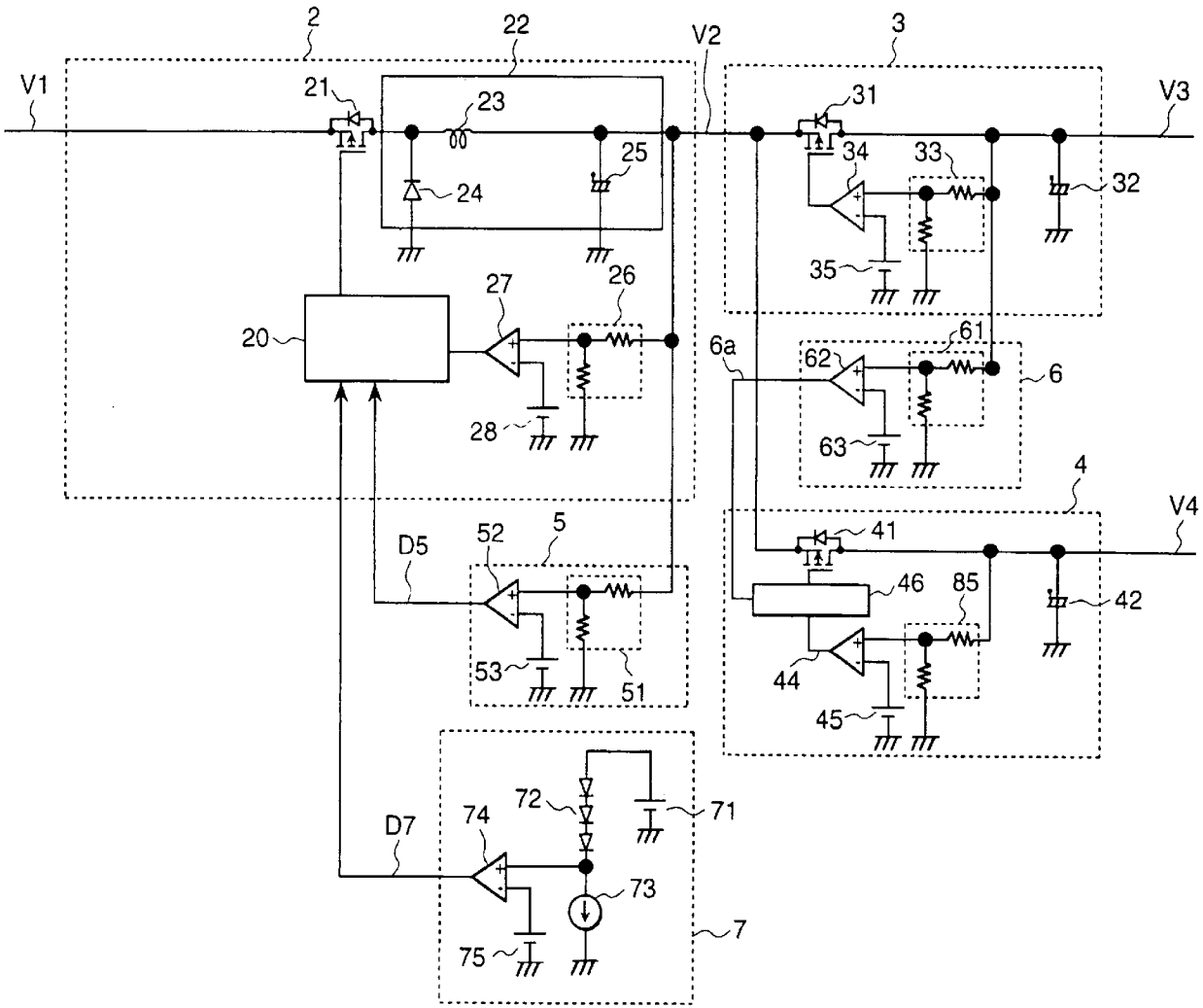
FIG. 2 is a detailed circuit diagram of electric power supply unit shown in FIG. 1.

FIG. 2 shows in detail each circuit of regulator 2, regulator 3, regulator 4, voltage detector 65, voltage detector 6, and overheating detector 7 in electric power supply unit 10 shown in FIG. 1.

In FIG. 2, regulator 2 is a depressor type switching regulator. The loss of the regulator is decreased by the application of the switching regulator to regulator 2 like this. When battery voltage V1 supplied by battery 1 in future is made a high voltage like 42V for instance, this application becomes further effective.

Because output voltage V2 (the first voltage) output from this regulator 2 is not input directly to microcomputer 8, but to regulator 3, the accuracy of the voltage is not required. Further, because it is not necessary to consider the influence of the ripple voltage of output voltage V2 generated by regulator 2, there is an advantage that cheap inductance 22 and capacitor 24 can be used.

That is, a smoothing circuit is connected to battery 1 through switching device 21, this switching device 21 controls in PWM (Pulse Width Modulation) battery voltage V1 supplied by battery 1, and outputs to smoothing circuit 22. This smoothing circuit comprises inductance 23, capacitor 24, and diode 25, which smoothes battery voltage V1 supplied by battery 1 PWM-controlled by using switching device 21, and outputs a constant voltage as output voltage V2 (the first voltage).

The positive input terminal (+) of OP amplifier 27 is connected to the output terminal of this smoothing circuit 22 through potential divider 26 comprising two resistors. The negative input terminal (−) of this OP amplifier 27 is connected to reference voltage generation circuit 28. Controller 20 is connected to the output terminal of this OP amplifier 27. This OP amplifier calculates the difference between a voltage input to the positive input terminal (+) and a voltage input to the negative input terminal (−), and outputs it to controller 20. Moreover, controller 20 controls the ON time of switching device 21 so that output voltage V2 output from regulator 2 according to the difference output from OP amplifier 27 can reach the target voltage V2*a* (for instance, 7.8V).

Regulator 2 comprises switching device 21, smoothing circuit 22, potential divider 26, OP amplifier 27, reference voltage generation circuit 28, and controller 20.

Regulator 3 is a linear regulator, which generates voltage 5V from output voltage V2 (for instance, 7.8V) output from regulator 2, and outputs it as output voltage V3 (the second voltage) for the I/O power supply unit of microcomputer 8. The linear regulator method is also effective to suppress the voltage of the ripple in order to apply output voltage V3 of 5V (the second voltage) output from regulator 3 to the reference voltage of the A/D converter of microcomputer 8.

This regulator 3 has switching device 31. The output terminal of regulator 2 is connected to the input terminal of this switching device 31. This switching device 31 controls in PWM (Pulse Width Modulation) output voltage V2 (the first voltage) output from regulator 2, generates the voltage of 5V for instance, and outputs it as the output voltage V3 (the second voltage) for the I/O power supply unit of microcomputer 8. The positive input terminal (+) of OP amplifier 34 is connected to the output terminal of this switching device 31 through potential divider 33. The negative output terminal (−) of this OP amplifier 34 is connected to reference voltage generation circuit 35, and output terminal of this OP amplifier 34 is connected to switching device 31.

This OP amplifier 34 calculates the difference between a value converted in voltage output voltage V3 output from switching device 31 and input to the positive input terminal (+) by potential divider 33 and the reference voltage output from reference voltage generation circuit 35 and input to the negative input terminal (−), and outputs the result to switching device 31. This switching device 31 carries out the switching operation during ON time according to the difference voltage output from OP amplifier 34. That is, the ON time of switching device 21 is controlled according to the difference output from OP amplifier 34, and target voltage V2*a* (for instance, 5V) is obtained from output voltage V3 (the second voltage) output from regulator 3. Reference numeral 32 designates a capacitor for the phase compensation to stabilize the feedback system of linear regulator 3.

Regulator 3 comprises these switching device 31, phase compensation capacitor 32, potential divider 33, OP amplifier 34, and reference voltage generation circuit 35.

Regulator 4 is a linear regulator which generates a voltage (for instance, 3.3V) different from output voltage V 3 (the second voltage) output from regulator 3. The loss is suppressed smaller because the voltage of 3.3V generated by this regulator 4 is depressed from output voltage V2 (the first voltage) output from regulator 2. Therefore, the linear regulator system with few parts can be adopted as regulator 4, This regulator 4 has switching device 41. The input terminal of this switching device 41 is connected to the output terminal of regulator 2. This switching device 41 controls in PWM (Pulse Width Modulation) output voltage V2 (the first voltage) output from regulator 2, generates the voltage of 3.3V for instance, and outputs it as output voltage V4 (the third voltage) for CPU core power supply unit of microcomputer 8. The positive input terminal (+) of OP amplifier 44 is connected to the output terminal of this switching device 41 through potential divider 43. The negative input terminal (−) of this OP amplifier 44 is connected to reference voltage generation circuit 45, and the output terminal of this OP amplifier is connected to controller 46.

This OP amplifier 44 calculates the difference between a value converted in voltage output voltage V4 output from switching device 41 and input to the positive input terminal (+) by potential divider 43 and the reference voltage supplied from reference voltage generation circuit 46 and input to the negative input terminal (−), and outputs the result to controller 46. This controller 46 controls the ON time of switching device 41 by using the difference output from OP amplifier 44 so that output voltage V4 output from regulator 4 may become target voltage V4*a* (for instance, 3.3V). This controller 46 carries out the switching operation of the start and stop of switching device 41 according to the value of output voltage V3 output from regulator 3.

Reference numeral. 42 is a capacitor for the phase compensation to stabilize the feedback system of linear regulator 4.

Regulator 4 comprises these switching device 41, capacitor 42 for phase compensation, potential divider 43, OP amplifier 44, reference voltage generation circuit 45, and controller 46.

Voltage detector 5 is one that observes the value of output voltage V2 output from regulator 2. That is, the output terminal of switching device 21 of regulator 2 is connected to the positive input terminal (+) of OP amplifier 52 through potential divider 51. Reference voltage generation circuit 53 is connected to the negative input terminal (−) of this OP amplifier 52. The output terminal of this OP amplifier 52 is connected to controller 20 of regulator 2. This OP amplifier 52 calculates the difference between a value converted in voltage output voltage V2 output from switching device 21 and input to the positive input terminal (+) by potential divider 51 and the reference voltage output from reference voltage generation circuit 53 and input to the negative input terminal (−), and outputs the detection signal D5 to controller 20 of regulator 2.

An OFF signal is input to controller 20 when the value of the voltage input 6 to the positive input terminal (+) of OP amplifier 52 through potential divider 51 become larger than the reference voltage output from reference voltage generation circuit 53 and input to the negative input terminal (−) of OP amplifier 62. An ON signal is input thereto when the value of the voltage input to the positive input terminal (+) of OP amplifier 52 through potential divider 51 become smaller than the reference voltage output from reference voltage generation circuit 53 and input to the negative input terminal (−) of OP amplifier 62. The reference voltage when the OFF signal is output from this OP amplifier 52 is the third set value, and the reference voltage when the ON signal is output from this OP amplifier 52 is the fourth set value. The third and fourth set values have a hysteresis characteristic.

Controller 20 of this regulator 2 turns off switching device 21 of regulator 2 when an OFF signal is output from OP amplifier 52, and turns on switching device 21 of regulator 2 when the ON signal is output from OP amplifier 52. The reason why the on-off control of switching device 21 by output voltage V2 output from regulator 2 is carried out by voltage detector 5 is to prevent microcomputer 8 from malfunctioning when output voltage V2 (the first voltage) output from the first regulator 2 drops less than the third set voltage (reference voltage output from reference voltage circuit 52).

Voltage detector 5 comprises potential divider 51, OP amplifier 52, and reference voltage generation circuit 53.

Voltage detector 6 observes the value of output voltage V3 (the second voltage) output from regulator 3. That is, the positive input terminal (+) of OP amplifier 62 is connected to the output terminal of switching device 31 of regulator 3 through potential divider 61. Reference voltage generation circuit 63 is connected to the negative input terminal (−) of this OP amplifier 62. The output terminal of this OP amplifier 62 is connected to controller 46 of regulator 4.

This OP amplifier 62 calculates the difference between a value converted in voltage output voltage V3 output from switching device 31 and input to the positive input terminal (+) by potential divider 61 and the reference voltage output from reference voltage generation circuit 63 and input to the negative input terminal (−), and outputs the detection signal D6 to controller 46 of regulator 4.

An OFF signal is input to controller 46 of this regulator 4 when the value of the voltage input to the positive input terminal (+) of OP amplifier 62 through potential divider 61 become larger than the reference voltage output from reference voltage generation circuit 63 and input to the negative input terminal (−) of OP amplifier 62. An ON signal is input thereto when the value of the voltage input to the positive input terminal (+) of OP amplifier 62 through potential divider 61 become smaller than the reference voltage output from reference voltage generation circuit 63 and input to the negative input terminal (−) of OP amplifier 62. The reference voltage when the OFF signal is output from this OP amplifier 62 is the first set value, and the reference voltage when the ON signal is output from this OP amplifier 62 is the second set value. The first and second set values have a hysteresis characteristic.

Controller 46 of this regulator 4 turns off switching device 41 of regulator 4 when an OFF signal is output from OP amplifier 62, and turns on switching device 41 of regulator 4 when the ON signal is output from OP amplifier 62. The reason why the on-off control of switching device 41 of regulator 4 by output voltage V3 output from regulator 3 is carried out by voltage detector 6 is to prevent microcomputer 8 from malfunctioning when output voltage V3 (the second voltage) output from regulator 3 drops less than the first set voltage (reference voltage output from reference voltage circuit 63).

Voltage detector 5 comprises potential divider 61, OP amplifier 62, and reference voltage generation circuit 63.

Overheating detector 7 observes the internal temperature of electric power supply unit 10. That is, a fixed electric current is supplied to thermal detector 72 by constant voltage generation circuit 71 and constant current source 73. The potential difference at the both ends of this thermal detector 72 changes according to the change in the internal temperature of electric power supply unit 10. Then, the potential difference caused by the temperature change in electric power supply unit 10 and reference voltage generation circuit 75 are compared with comparator 74. Detection signal D7 of this comparator 74 changes when the potential difference at both ends of thermal detector 72 changes, that is, the internal temperature of electric power supply unit 10 reaches a set temperature (the first overheating level). Namely, detection signal D7 output from comparator 74 changes from a Low signal into a Hi signal. Moreover, detection signal D7 output from comparator 74 changes from the Hi signal into the Low signal when the internal temperature of electric power supply unit 10 exceeds the set temperature (the first overheating level), and descends to the temperature less than a set temperature (the second overheating level). Detection signal D7 output from this comparator 74 is input to controller 20 of regulator 2.

Controller 20 of this regulator 2 turns on switching device 21 of regulator 2 when the detection signal D7 at Low level is output from comparator 74, and turns off switching device 21 of regulator 2 when the detection signal D7 at High level is output from comparator 74. The reason why the on-off control of switching device 21 by output voltage V2 output from regulator 2 is carried out by overheating detector 7 is to prevent the components of electric power supply unit 10 from malfunctioning or breaking down when the internal temperature of electric power supply unit 10 rises abnormally. The reference voltage when detection signal D7 at a Hi level is output from this comparator 74, a set temperature (the first overheating level), and a set temperature (the second overheating level) when the Low signal is output from comparator 74 have a hysteresis characteristic.

Overheating detector 7 comprises constant voltage generation circuit 71, thermal detector 72, constant current source 73, comparator 74, and reference voltage generation circuit 75.

As described above, in controller 20 of regulator 2, the starting/stopping of switching device 21 of regulator 2 (starting/stopping of regulator 2) is decided depending on detection signal D5 output from detector 5 and detection signal D7 output from overheating detector 7.

Although a plurality of reference voltage generation circuits are used in this embodiments, one reference voltage generation circuit is generally used. Voltages are supplied to each part through the buffer.

Figure 3:
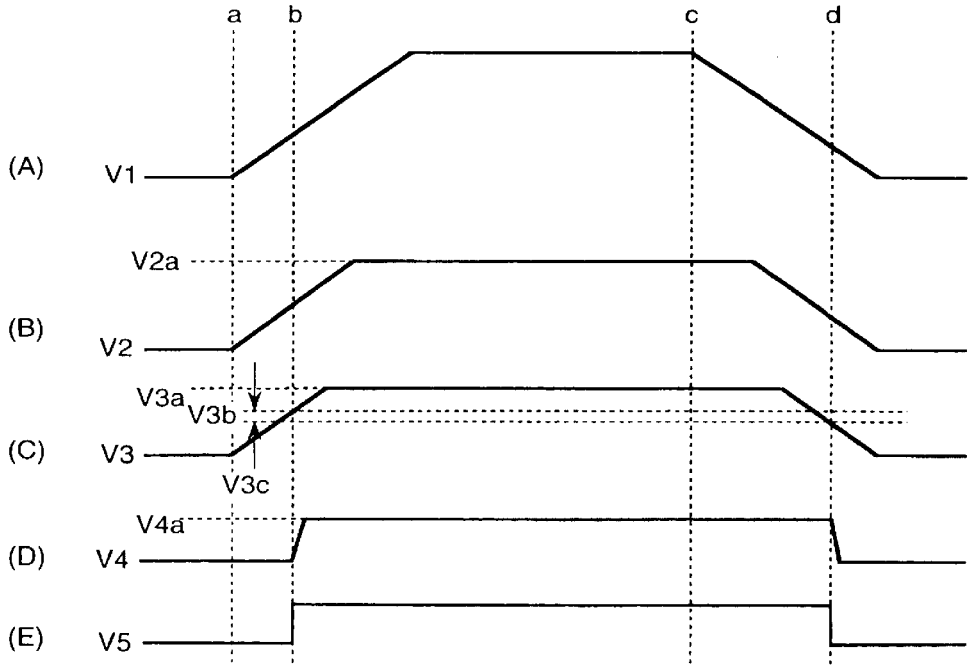
FIG. 3 is a timing chart of the output voltage of each regulator at the starting/stopping of the battery voltage supplied by the battery according to the first embodiment of the electric power supply unit shown in FIG. 2.

FIG. 3 shows a timing chart of the output voltage of each regulator at the starting/stopping of the battery voltage V1 supplied by battery 1.

In FIG. 3, battery voltage V1 is first supplied at timing a and electric power supply unit 10 is started as shown in FIG.

3(A). When battery voltage V1 is supplied by this battery 1, regulator 2 is started as shown in FIG. 3(B). Output voltage V2 of regulator 2 approaches target voltage V2*a* as the battery voltage supplied by battery 1 rises. When regulator 2 is started and output voltage V2 is output, regulator 3 is started as shown in FIG. 3(C). Output voltage V3 of regulator 3 approaches target voltage V3*a* as the battery voltage V2 output from regulator 2 rises.

The limitation by expression (1) exists between output voltage V3 output from regulator 3 and output voltage V4 output from regulator 4 in microcomputer 8 with a plurality of power supplies.

$$\text{output voltage V3} \geqq \text{output voltage V4} \quad (1)$$

Moreover, The limitation by expression (2) exists according to microcomputer 8.

$$\text{output voltage V3} \sim \text{output voltage V4} \leqq \text{fixed voltage} \quad (2)$$

It is necessary to control regulator 4 so that expression (1) and expression (2) may hold for the starting/stopping of regulator 4. That is, when voltage detector 6 detects at timing b that output voltage V3 output from regulator 3 is larger than voltage V3*b* (larger than target voltage V4*a* of regulator 4) as shown in FIG. 3(C), voltage detector 6 starts regulator 4 by detection signal D6 (ON signal).

AT this point, voltage V3*b* becomes a difference voltage between output voltage V3 output from regulator 3 and output voltage V4 output from regulator 4. Therefore, voltage V3*b* is set so that expression (3) may be satisfied.

$$\text{voltage V4}a \leqq \text{voltage V3}b \leqq \text{fixed voltage} \quad (3)$$

At timing c shown in FIG. 3, when battery voltage V1 supplied by battery 1 stops, output voltage V2 output from regulator 2 starts to drop, following battery voltage V1 as shown in FIG. 3(B). Further, output voltage V3 output from regulator 3 also starts to drop as shown in FIG. 3(C).

When voltage detector 6 detects output voltage V3 output from regulator 3 satisfying the condition of expression (4) voltage detector 6 changes detection signal D6 from the ON signal at the Hi level into the OFF signal at the Low level and output it at timing d as shown in FIG. 3(E).

$$\text{output voltage V3} \leqq \text{voltage V3}b \sim \text{hysteresis voltage V3}c \quad (4)$$

When an OFF signal is output from this detector 6, regulator 4 is stopped by the OFF signal. Regulator 4 is stopped like this by the OFF signal from detector 6, output voltage V4 output from regulator 4 is made to drop prior to output voltage V3 output from regulator 3, and the condition of expression (1) and expression (2) is satisfied.

Hysteresis voltage V3*c* is set to satisfies following expression (5).

$$\text{voltage V4}a \leqq \text{voltage V3}b \sim \text{hysteresis voltage V3}c \quad (5).$$

Figure 4:
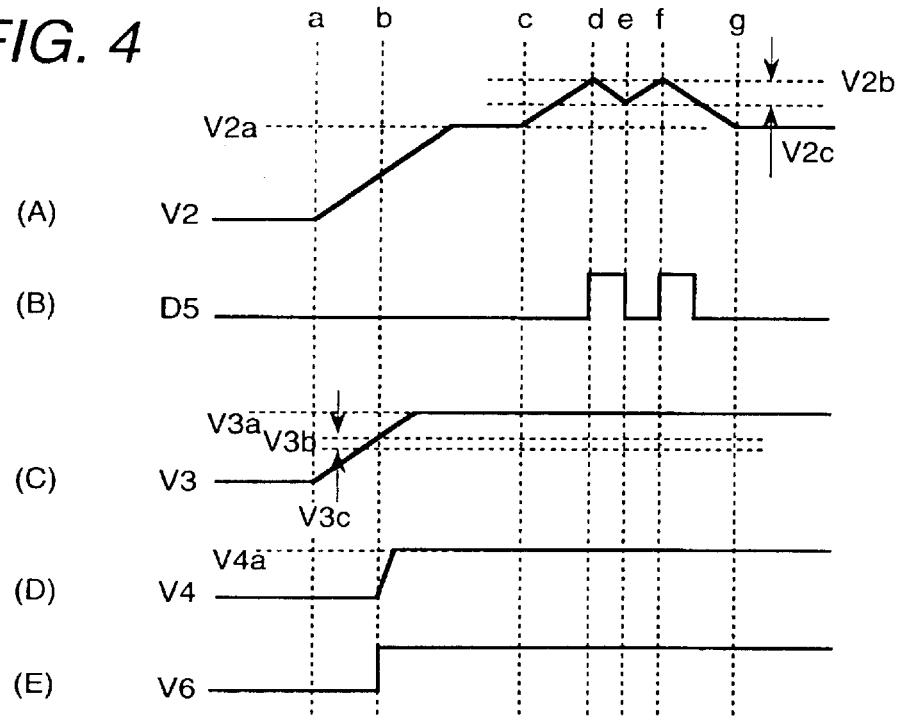
FIG. 4 is a timing chart at the time the output voltage output from the regulator according to the first embodiment of the electric power supply unit shown in FIG. 2.

FIG. 4 shows a timing chart when output voltage V2 output from regulator 2 becomes an abnormal voltage.

At timing a shown in FIG. 4, battery voltage V1 is first supplied by battery 1 and electric power supply unit 10 starts. Regulator 2 is started as shown in FIG. 4(A) when battery voltage V1 is supplied from battery 1. Output voltage V2 of regulator 2 approaches target voltage V2*a* as battery voltage V1 supplied by battery 1 rises. When regulator 2 is started and output voltage V2 is output, regulator 3 is started as shown in FIG. 4(B). Output voltage V3 of regulator 3 approaches target voltage V3*a* as battery voltage V2 output from regulator 2 rises.

When regulator 3 is started like this, Output voltage V3 output from regulator 3 is received by regulator 4, and an ON signal (detection signal D6) is output from detector 6 at timing b shown in FIG. 4 where output voltage V3 output from regulator 3 becomes more than voltage V3*b*.

The normal operation waveform is obtained at each part from timing b shown in FIG. 4 to timing c shown in FIG. 3.

When output voltage V2 output from regulator 2 rises by some causes as shown in FIG. 4(A) at timing c shown in FIG. 4, overvoltage (the third set value) is detected by voltage detector 5 at timing d shown in FIG. 4, and voltage V2 reaches voltage V2*b* (overvoltage judgment value), detection signal D5 (overvoltage OFF signal) is output to controller 20 of regulator 2 as shown in FIG. 4(B). When detection signal D5 (overvoltage OFF signal) is output from detector 5, regulator 2 is intercepted by detection signal D5 (overvoltage OFF signal) output from detector 5.

When the output of output voltage V2 output from this regulator 2 is stopped, battery voltage V1 supplied by battery 1 is intercepted electrically. After that, output voltage V2 output from regulator 2 begins to drop as shown in FIG. 4(A), and voltage detector 5 detects hysteresis voltage V2*c* at timing e shown in FIG. 4. That is, when voltage detector 5 detects output voltage V2 output from regulator 2 which satisfies following expression (6) at timing e shown in FIG. 4, voltage detector 5 outputs detection signal D5 (reactivation voltage ON signal) and reactivates regulator 2.

$$\text{output voltage V2} \leqq \text{voltage V2}b \sim \text{hysteresis voltage V2}c \quad (5)$$

Output voltage V2 output from regulator 2 rises again after the reactivation of this regulator 2. When overvoltage (the third set value) detected again by voltage detector 5 at timing f shown in FIG. 4 reaches voltage V2*b* (overvoltage judgment value), detection signal D5 (overvoltage OFF signal) is output from detector 5 to controller 20 of regulator 2 again as shown from detector as shown in FIG. 4(B). When detection signal D5 (overvoltage OFF signal) is output from this detector 5, regulator 2 is intercepted again by detection signal D5 (overvoltage OFF signal) output from this detector 5. That is, battery voltage V1 supplied by battery 1 is intercepted electrically by stopping the output of output voltage V2 output from regulator 2. Voltage detector 5 outputs detection signal D5 (reactivation voltage ON signal) and reactivates regulator 2 when output voltage V2 output from regulator 2 drops up to hysteresis voltage V2*c* at timing g shown in FIG. 4 as shown in FIG. 4(A).

The interception and reactivation are repeated to suppress to overvoltage judgment value V2*b* or less and protect the regulator in subsequent stage from the loss deterioration when output voltage V2 output from this regulator 2 is not stabilized to target voltage V2*a* as shown in graph from timing d to timing g. Regulator 2 is intercepted when output voltage V2 detected by voltage detector 5 and output from regulator 2 reaches overvoltage judgment value V2*b*, regulator 2 reactivates when output voltage V2 output from regulator 2 begins to drop and reaches hysteresis voltage V2*c*, and voltage detector 5 detects hysteresis voltage V2*c*.

After then, If this regulator 2 is reactivated and has returned normally (when output voltage V2 output from regulator 2 does not rise again after the reactivation), Output voltage V2 output from regulator 2 becomes target voltage V2*a* at timing 9 shown in FIG. 4, and becomes steady at target voltage V2*a* thereafter.

Figure 5:
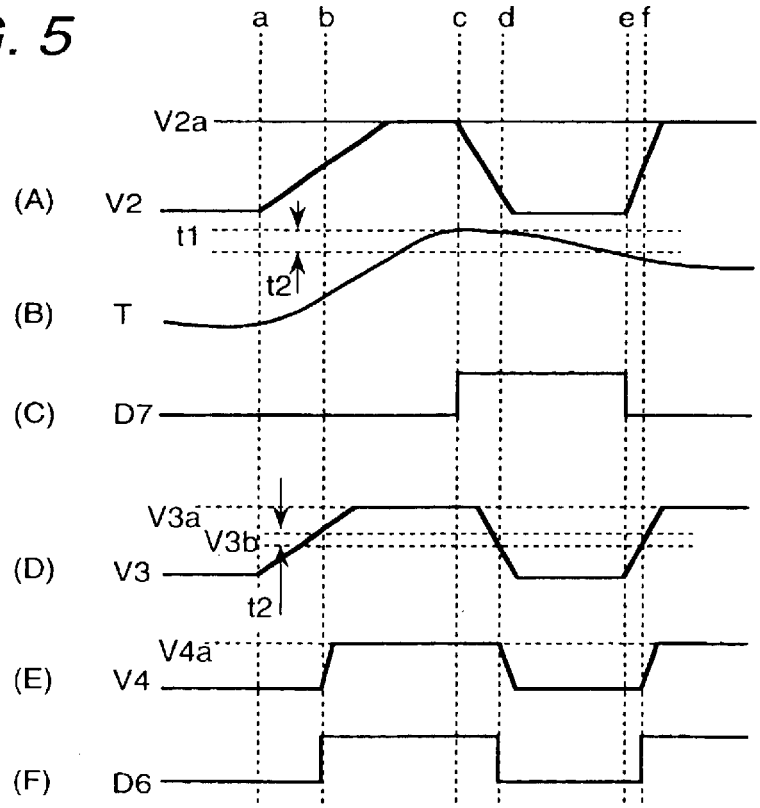
FIG. 5 is a flow chart showing the state when electric power supply unit 10 according to the first embodiment overheats, and the internal temperature of electric power supply unit 10 becomes abnormal.

FIG. 5 is a flow chart showing the state when electric power supply unit 10 overheats, and the internal temperature of electric power supply unit 10 becomes abnormal.

In FIG. 5, battery voltage V1 is first supplied from battery 1 at timing a shown in FIG. 5 and electric power supply unit 10 is started. Regulator 2 is started when battery voltage V1 is supplied from battery 1 as shown in FIG. 5(A). Output voltage V2 of regulator 2 approaches target voltage V2*a* as battery voltage V1 supplied by battery 1 rises. When regulator 2 is started and output voltage V2 is output, regulator 3 is started as shown in FIG. 5(D). Output voltage V3 of regulator 3 approaches target voltage V3*a* as battery voltage V2 output from regulator 2 rises.

The ON signal (detection signal D6) is output from detector 6 at timing b shown in FIG. 4 where output voltage V3 output from regulator 3 becomes voltage V3*b* or more after regulator 3 starts as shown in FIG. 5(E). Regulator 4 starts as shown in FIG. 5(E) by the ON signal (detection signal D6) from detector 6, and output voltage V4 output from regulator 4 rises.

The normal operation waveform is obtained at each part at the time of timing b to timing c shown in FIG. 5. Now, overheating detector 7 detects that the internal temperature of electric power supply unit 10 becomes an abnormal temperature when temperature T in electric power supply unit 10 reaches the first set temperature t1 by some causes as shown in FIG. 5(B) at timing c shown in FIG. 5. Overheating detector 7 outputs the signal (Hi signal) obtained by reversing detection signal D7 (Low signal) as shown in FIG. 5(C). This reversed detection signal D7 from overheating detector 7 is received, and regulator 2 is stopped as shown in FIG. 5(C). Output voltage V2 output from regulator 2 drops as shown in FIG. 5(A), and output voltage V3 output from regulator 3 drops following the drop of output voltage V2 as shown in FIG. 5(D).

When output voltage V3 output from this regulator 3 decreases, and output voltage V3 output from regulator 3 decreases up to voltage V3*b*~hysteresis voltage V3*c* as shown in FIG. 5(D), voltage detector 6 detects varying output voltage V3 output from regulator 3, and outputs the signal (Low signal) obtained by reversing detection signal D6 (Hi signal) as shown in FIG. 5(F). Regulator 4 is stopped by detection signal D6 of voltage detector 6, and output voltage V4 output from regulator 4 is decreased.

When temperature T in electric power supply unit 10 descends after stopping regulator 2, and decreases up to temperature t1~t2 as shown in FIG. 5(B) at timing e shown in FIG. 5, detection signal D7 of overheating detector 7 reverses from the Hi signal (OFF signal) to the Low signal (ON signal) as shown in FIG. 5(C). Regulator 2 is reactivated as shown in FIG. 5(A) upon receipt of the reversed detection signal D7 from overheating detector 7 as shown in FIG. 5(C) at timing e shown in FIG. 5. As a result, output voltage V2 output from regulator 2.

Output voltage V3 output from regulator 3 rises, following the rise of output voltage V2.

When output voltage V3 reaches voltage V3*b* or more, output from regulator 3 like showing to FIG. 5(D), detection signal D6 of voltage detector 6 is reversed to the Hi signal (ON signal) as shown in FIG. 5(F), regulator 4 is started and output voltage V4 from regulator 4 rises as shown in FIG. 5(E).

Figure 6:
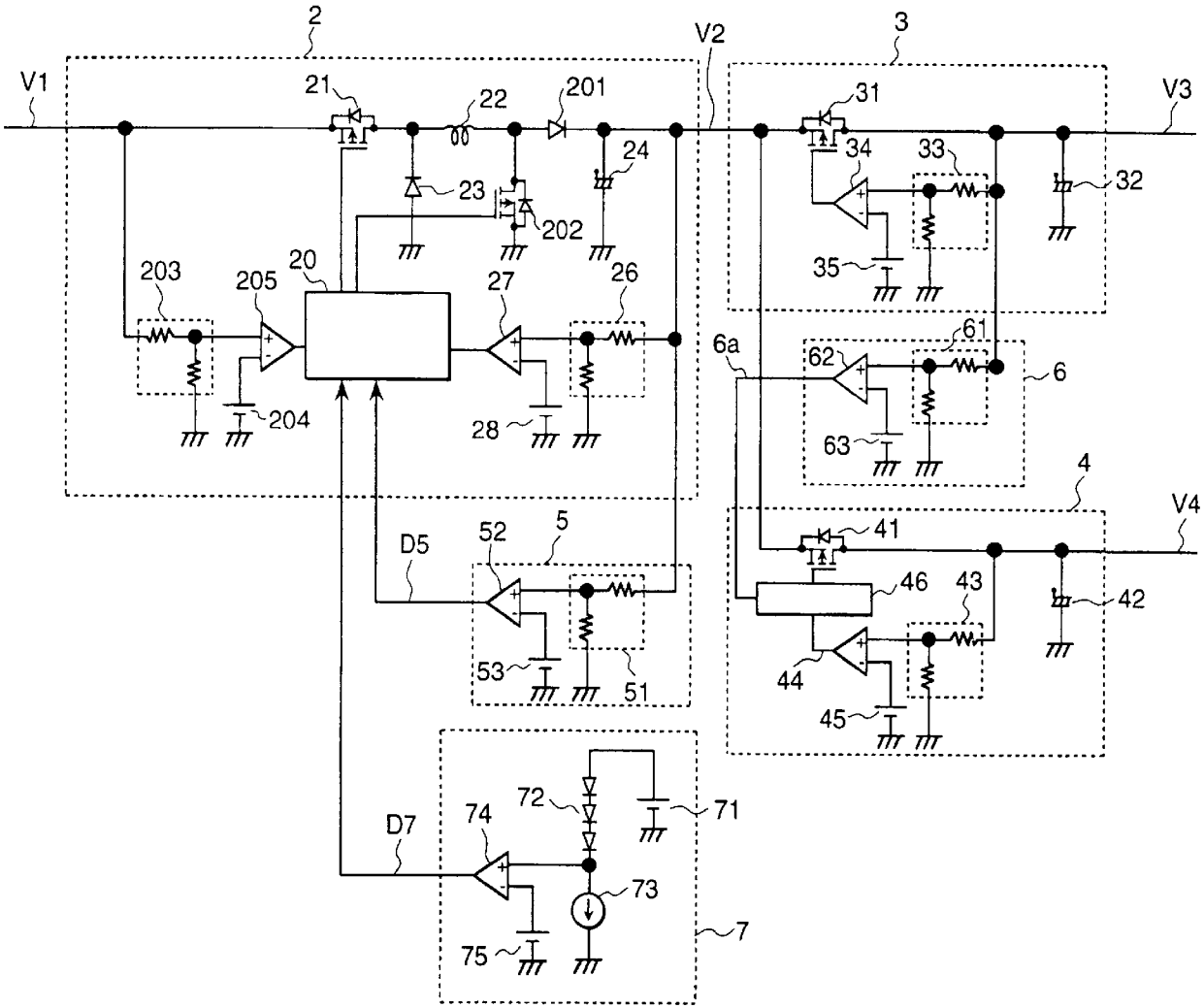
FIG. 6 is a circuit diagram showing the second embodiment of the electric power supply unit according to the present invention.

A second embodiment of electric power supply unit according to the present invention is shown in FIG. 6.

The different point in configuration between the second embodiment shown in FIG. 6 and the first embodiment shown in FIG. 2 is in that the going up and down type switching regulator is used in the second embodiment though the first embodiment adopts the going down type switching regulator. Because other components in the second embodiment are the same as ones in the first embodiment, the explanation for them is omitted herein.

In FIG. 6, switching device 202, diode 201, potential divider 203, reference voltage generation circuit 204, and comparator 205 are added to the configuration shown in FIG. 2. The added circuit operates when battery voltage V1 supplied by battery 1 is lower than target voltage V2*a* of output voltage V2 output from regulator 2. Output voltage V2 output from regulator 2 lower than target voltage V2*a* is detected by comparing the voltage divided by potential divider 203 with the reference voltage from reference voltage generation circuit 204 by using comparator 205.

That is, switching device 21 is fixed at an ON state under the following condition.

$$\text{battery voltage V1} \leqq \text{target voltage V2}a$$

Battery voltage V1 supplied by battery 1 is boosted by the PWM control of switching device 202 to generate output voltage V2 output from regulator 2.

Output voltage V2 output from regulator 2 controls an amount of the electric current supplied by calculating the difference between the reference voltage supplied by the reference voltage generation circuit 26 and the voltage divided by potential divider 25 by OP amplifier 27, that is, an amount of the PWM for switching device 202.

When the relationship between the battery voltage V1 supplied from battery 1 and target voltage V2*a* of output voltage V2 output from regulator 2 satisfies the following express, the going down operation is performed.

$$\text{battery voltage V1} > \text{target voltage V2}a$$

That is, switching device 202 is fixed at an OFF state, and output voltage V2 output from regulator 2 is depressed by the PWM control of switching device 21 as well as the case in the first embodiment shown in FIG. 2.

Figure 7:
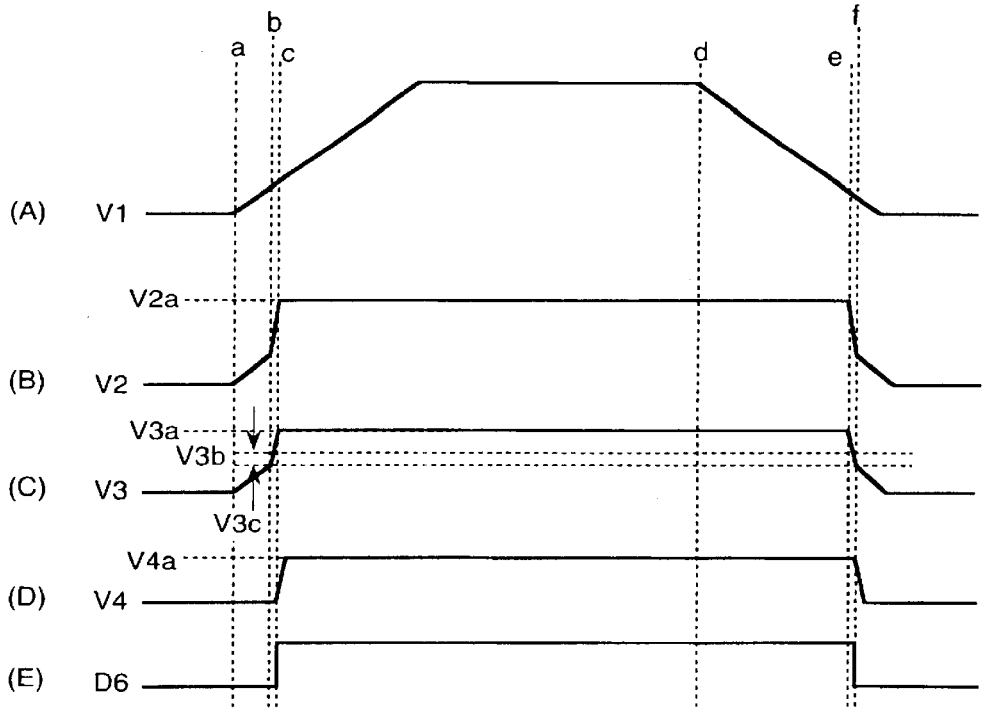
FIG. 7 is a timing chart at the starting/stopping of the battery according to the second embodiment of the electric power supply unit shown in FIG. 6, in which a going up and down type switching regulator is used.

FIG. 7 shows a timing chart at the starting/stopping of power supply unit where a going up and down type switching regulator is used as regulator 2.

FIG. 7 shows waveforms at the starting/stopping of the power supply unit where a going up and down type switching regulator is used as regulator 2.

In FIG. 7, battery voltage V1 is first supplied from battery 1 at timing a shown in FIG. 7 as shown in FIG. 7(*a*) and electric power supply unit 10 is started. Regulator 2 is started when battery voltage V1 is supplied from battery 1 as shown in FIG. 7(B). Output voltage V2 of regulator 2 also rises as battery voltage V1 supplied by battery 1 rises. When regulator 2 is started and output voltage V2 is output, regulator 3 is started as shown in FIG. 7(C). Output voltage V3 of regulator 3 also rises as battery voltage V2 output from regulator 2 rises.

The switching device 202 for a booster regulator starts to perform the PWM operation when battery voltage V1 supplied by battery 1 rises up to an operable voltage at timing b as shown in FIG. 7(A). Output voltage V2 output from regulator 2 begins to perform the boosting operation toward target voltage V2*a* as shown in FIG. 7(B). Output voltage V3 output from regulator 3 follows and rises as shown in FIG. 7(C) from the beginning of this boosting operation. When voltage detector 6 detects that output voltage V3 output from regulator 3 reaches voltage V3*b* or more as shown in FIG. 7(C), detection signal D6 (Hi signal) is output from voltage detector 6 to controller 46 of regulator 4.

Regulator 4 is started by detection signal D6 of this voltage detector 6, and output voltage V4 output from regulator 4 rises. Output voltage V4 output from regulator 4 begins to rise toward target voltage V4*a* at timing c shown in FIG. 7 when this regulator 4 is started. When battery voltage V1 supplied by battery 1 reaches voltage V2*a* or more, regulator 2 stops the boosting operation as shown in FIG. 7 (A), that is, switching device 202 is stopped, and the going down operation by the PWM control of switching device 21 is started.

When battery voltage V1 supplied by battery 1 drops and battery voltage V1 reaches voltage V2*a* or less at timing d shown in FIG. 7 as shown in FIG. 7(A), regulator 2 stops the going down operation, that is, switching device 202 is fixed in an ON state, and the boosting operation by the PWM control of switching device 202 is started.

When battery voltage V1 supplied by battery 1 reaches booster circuit operable voltage or less at timing e shown in FIG. 7 as shown in FIG. 7(A), regulator 2 is stopped as shown in FIG. 7(B).

Output voltage V2 output from regulator 2 follows battery voltage V1 supplied by battery 1 and drops.

When voltage detector 6 detects that output voltage V3 output from regulator 3 reaches voltage V3*b*~hysteresis voltage V3*c* or less, voltage detector 6 outputs detection signal D6 (Low signal) to controller 46 of regulator 4 as shown in FIG. 7(E). Regulator 4 is intercepted by detection signal D6 from voltage detector 6.

Figure 8:
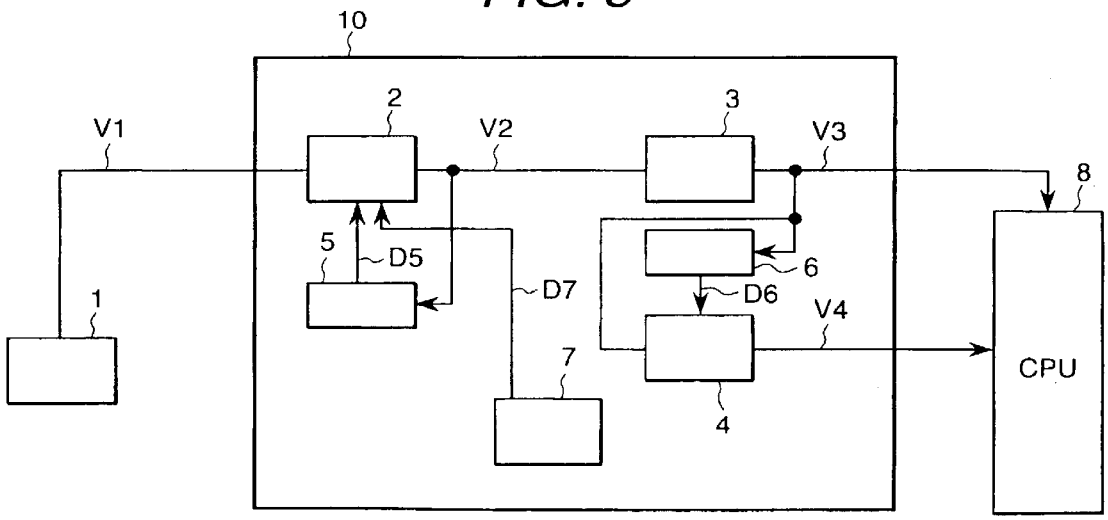
FIG. 8 is a block diagram showing a third embodiment of the electric power supply unit according to the present invention.

A third embodiment of electric power supply unit according to the present invention is shown in FIG. 8.

The different point in configuration between the third embodiment shown in FIG. 8 and the first embodiment shown in FIG. 1 is in that regulator 4 is connected at the subsequent stage of regulator 3 in the third embodiment shown in FIG. 8 though regulators 3 and 4 are connected in parallel with voltage V2 output from regulator 2 in the first embodiment. Other components in the third embodiment are the same as ones in the first embodiment. The third embodiment shown in FIG. 8 does not have the difference in effect compared with the first embodiment Although in the first embodiment shown in FIG. 1 and the second embodiment shown in FIG. 6, regulator 2 is composed of the switching regulator and regulators 3 and 4 are composed of the linear regulator, the present invention is not limited to such configuration. In addition, although three regulators are used in the first embodiment shown in FIG. 1 and the second embodiment shown in FIG. 6, the present invention is not limited to three regulators, and a plurality of regulators can be used by various requests.

What is claimed is:

1. An electric power supply unit comprising:

a first regulator which converts the voltage of a battery supplied by the battery into a fixed voltage;

a second regulator which generates a lower voltage than said first regulator;

a voltage detection means which outputs an OFF signal when the output voltage of the first regulator drops less than a first set voltage, and output an ON signal when the output voltage of said first regulator rises more than a second set voltage; and a means which stops the voltage output from said second regulator when the OFF signal is output from said voltage detection means.

2. An electric power supply unit according to claim 1, wherein said first set voltage is higher than the output voltage generated by said second generator.

3. An electric power supply unit according to claim 2, wherein said second regulator for which the voltage output has been stopped is started when the ON signal is output from said voltage detection means, the battery voltage supplied again by the battery is converted, and the fixed voltage is output.

4. An electric power supply unit according to claim 1, wherein said second set voltage is higher than said first set voltage.

5. An electric power supply unit comprising:

a first regulator which converts the battery voltage supplied by the battery into a first voltage;

a third regulator which converts the first voltage output from said first regulator into a second voltage;

a second regulator which converts the first voltage output from said first regulator into a third voltage;

a first voltage detection means which outputs an OFF signal when the second voltage output from said third regulator drops to a value less than a first set voltage, and outputs an ON signal when the second voltage output from said third regulator rises more than the second set voltage, and a means which stops the voltage output from said second regulator when an OFF signal is output from said first voltage detection means.

6. An electric power supply unit comprising:

a first regulator which converts a battery voltage into a first voltage;

a third regulator which converts the second voltage output from said second regulator into a first voltage;

a second regulator which converts the second voltage output from said third regulator into a third voltages, a first voltage detection means which outputs an OFF signal when the second voltage output from said third regulator drops to a value less than a first set voltage, and outputs an ON signal when the second voltage output from said third regulator rises to a value more than the second set voltage, and a means which stops the voltage output from said second regulator when an OFF signal is output from said first voltage detection means.

7. An electric power supply unit according to claim 5, further comprising:

a second voltage detection means which stops the first voltage output from said first regulator by outputting an OFF signal when the first voltage output from said first regulator drops less than the third set voltage, and outputs the first voltage output from said first regulator by outputting the ON signal when the first voltage output from said first regulator rises more than a set voltage of the fourth.

8. An electric power supply unit according to claim 5, wherein said first set voltage is higher than the third voltage generated by the second regulator.

9. An electric power supply unit according to claim 5, wherein when the ON signal is output from said first voltage detection means, said second regulator for which the voltage output has been stopped is started, the battery voltage supplied again by the battery is converted to output the fixed voltage.

10. An electric power supply unit according to claim 5, wherein, said second set voltage is higher than said first set voltage.

11. An electric power supply unit according to claim 5 wherein, said first set voltage and said second set voltage are lower than a third set voltage.

12. An electric power supply unit according to claim 5, further comprising:

a means which supplies the second voltage output from the third regulator and the third voltage output from said second regulator to a microcomputer as two or more power units for the microcomputer, wherein said third fixed voltage is lower than the power unit potential difference limited by said microcomputer.

13. An electric power supply unit according to claim 5, wherein when an ON signal is output from said second voltage detection means, said first regulator for the first voltage has been stopped is started, and the battery voltage supplied again by the battery is converted to output the first voltage.

14. An electric power supply unit according to claim 13, wherein a fourth set voltage restarted after the first regulator is stopped is a hysteresis voltage, based on said third set voltage when the first voltage output from said first regulator is abnormal.

15. An electric power supply unit to claim 5, further comprising:

an overheating detector provided in an electric power supply unit, which detects overheating, wherein when said overheating detector detects that the internal temperature of electric power supply unit is at a preset temperature, an output of the first voltage from said first regulator is stopped.

16. An electric power supply unit according to claim 15, further comprising:

a means which restarts said first regulator when the internal temperature of electric power supply unit detected by the overheating detector drops less than the preset temperature after said first regulator is stopped.

17. An electric power supply unit according to claim 16, wherein a set temperature of said overheating detector has a hysteresis characteristic.

18. An electric power supply unit according to claim 5, wherein said first regulator comprises a switching regulator, and said second and third regulators comprises linear regulators.

19. An electric power supply unit according to claim 5, wherein said first regulator comprises a variable pressure switching regulator, and said second and third regulators are linear regulators.

* * * * *